US005878921A

United States Patent [19]

Chase et al.

[11] Patent Number: 5,878,921

[45] Date of Patent: Mar. 9, 1999

[54] GROUT DELIVERY APPARATUS AND METHOD

[75] Inventors: Steven L. Chase, Salt Lake City; Steven C. Nelson, Sandy, both of Utah

[73] Assignee: Mud King, LLC, Salt Lake City, Utah

[21] Appl. No.: 568,151

[22] Filed: Dec. 6, 1995

[51] Int. Cl.[6] ..... B65D 88/54

[52] U.S. Cl. ..... 222/333; 222/529; 222/626

[58] Field of Search ..... 340/825.72; 222/63, 222/185.1, 608, 611.2, 126, 333, 526, 529, 23

[56] References Cited

U.S. PATENT DOCUMENTS 3,162,328 12/1964 Frume ..... 222/608
3,768,939 10/1973 Grambling ..... 222/626
4,365,728 12/1982 Tokorozawa et al. ..... 222/63
5,314,100 5/1994 Deaver ..... 222/626

*Primary Examiner*—Philippe Derakshani
*Attorney, Agent, or Firm*—J. Winslow Young

[57] ABSTRACT

A grout delivery apparatus and method for delivering grout through a flexible conduit from a bulk supply of grout to a hand tool. The bulk supply of grout is held in a hopper which feeds the grout under gravity to a pump. The pump is driven by an electric motor which receives its electrical energy through a controller. The controller is adjustably preset to control the electric motor as a function of the individual settings on a multifunction switch operable by the worker. The switch can either be mounted on the hand tool and directly wired to the controller or incorporated into a remote transmitter which transmits the particular switch position to a receiver on the controller.

13 Claims, 3 Drawing Sheets

GROUT DELIVERY APPARATUS AND METHOD

BACKGROUND

1. Field of the Invention

This invention relates to grout delivery systems and, more particularly, to a novel grout delivery apparatus and method wherein the grout is controllably pumped from a reserve supply of grout through a flexible conduit to the dispensing tool.

2. The Prior Art

The construction trade, whether commercial or residential, includes various construction activities that involve the controlled application of a semi-liquid or plastic-type material such as paste, adhesive, plaster, grout, drywall compound, and the like. Through common usage, these various compositions are referred to in the construction trade as "mud" whether the worker is a bricklayer, concrete finisher, plasterer, carpenter, drywall finisher, etc. However, for ease of understanding and to avoid any negative connotation herein from the use of the term "mud," the term "grout" will be used to denote any suitable, semi-liquid material capable of being pumped through a flexible conduit.

Grout when used to fill cracks or holes in concrete consists of a mixture of cement, sand or aggregate, and water. When used as a plaster, grout usually consists of a mixture of cement, fibers, fine sand, water, and coloring material. When used as mortar for bricks, grout consists of a mixture of cement, sand, and water. Drywall applications, on the other hand, use a grout that is a very fine, plastic-like material with little or no shrinkage upon drying for use in patching nail holes and joints in the drywall surface. Drywall grout also bonds a joint tape over to joints and in the corners of the drywall construction to provide a smooth, continuous wall surface. For carpentry purposes, many procedures call for the application of a bead of adhesive laid along several studs, rafters or other longitudinal members prior to mounting a sheet of plywood, plaster board, or the like, thereto.

In all of the foregoing applications the particular construction worker customarily applies the grout for the particular construction activity by obtaining it from a bulk source such as a hod or bucket, or in the case of adhesives, from a dispensing tube or cartridge. Regardless of the particular grout or its mode of application, the construction worker must take valuable work time to return to the bulk container of grout to refill the particular device used for carrying the grout during the application procedure. One particular attempt to overcome one aspect of this problem is the device advertised as an automatic taper and drywall finishing system made commercially available by TapeTech Tool Company of Hayward, Calif. This particular tool holds a quantity of grout in either the head or the handle with the grout being delivered to the application surface by being forced from the head or handle by the worker. However, the worker must still return periodically to the bulk supply of grout to replenish the on-hand supply of grout.

The phrase "on-hand supply" refers to the quantity of grout carried, for example, on a mortar board held by the nonworking hand of the worker such as a bricklayer or plasterer. It is from this supply that the worker replenishes the grout being applied by the hand tool to the surface. The worker is limited to a maximum weight of about five kilograms of grout at any one time thereby also necessitating the frequent returns to the bulk supply to replenish the on-hand supply.

As can be seen readily from the foregoing description the worker is impeded in the application of grout for several reasons: first, only a limited quantity of grout can be carried at any given time due to the weight of the same and the need to reduce excessive drying or setting of the on-hand supply of grout; second, the worker is limited to the use of only one hand for operation of the hand tool since the other hand is supporting the mortar board with its on-hand supply of grout; third, the overall expenditure of worker energy in the frequent trips to the bulk supply of grout, the carrying and one hand support of the on-hand supply of grout; and the limitation of the worker to the use of only one hand all contribute to worker fatigue which, in turn, inherently means a lower quality of work, increased risk of accidents, more worker illness or disability through repetitive stress syndrome, and increased spillage and debris from splattered and spilled grout.

Clearly, each of these prior art techniques limits the productivity of the worker by requiring the worker to return periodically to the bulk container in order to replenish the on-hand supply of grout. This is particularly cumbersome if the worker is working on stilts, a scaffold, or some other location not otherwise within easy access of the bulk supply of grout.

In view of the foregoing it would be an advancement in the art to provide a grout delivery apparatus for delivering grout to the worker. It would also be an advancement in the art to provide a grout delivery apparatus wherein the quantity of grout delivered to the worker is controlled by the worker. An even further advancement in the art would be to provide a grout delivery apparatus wherein the grout is delivered to the tool of the worker through a relatively small diameter, flexible conduit thereby reducing the fatigue of the worker. Such a novel apparatus and method is disclosed and claimed herein.

BRIEF SUMMARY AND OBJECTS OF THE INVENTION

This invention is an apparatus and method for delivering a pumpable grout to the hand tool of a worker. The apparatus includes a hopper into which a bulk quantity of the grout is poured and a pump for delivering the grout to the hand tool through a relatively small diameter, flexible conduit. A controller is operable by the worker and controls the rate of delivery of the grout to the hand tool.

It is, therefore, a primary object of this invention to provide a grout delivery apparatus for delivering a controllable flow of grout to the hand tool of the worker.

Another object of this invention is to provide improvements in the method of delivering grout to a hand tool.

Another object of this invention is to provide a grout delivery apparatus wherein a pump is used to force grout through a relatively small diameter, flexible conduit.

Another object of this invention is to provide a transportable pump and hopper system for containing a relatively large volume of grout for use by the worker.

Another object of this invention is to provide a grout delivery apparatus that includes a recycle conduit for returning surplus grout pumped by the pump to the bulk hopper.

These and other objects and features of the present invention will become more readily apparent from the following description and appended claims taken in conjunction with the accompanying drawing.

DETAILED DESCRIPTION OF THE PREFERRED EMBODIMENT

Figure 1:
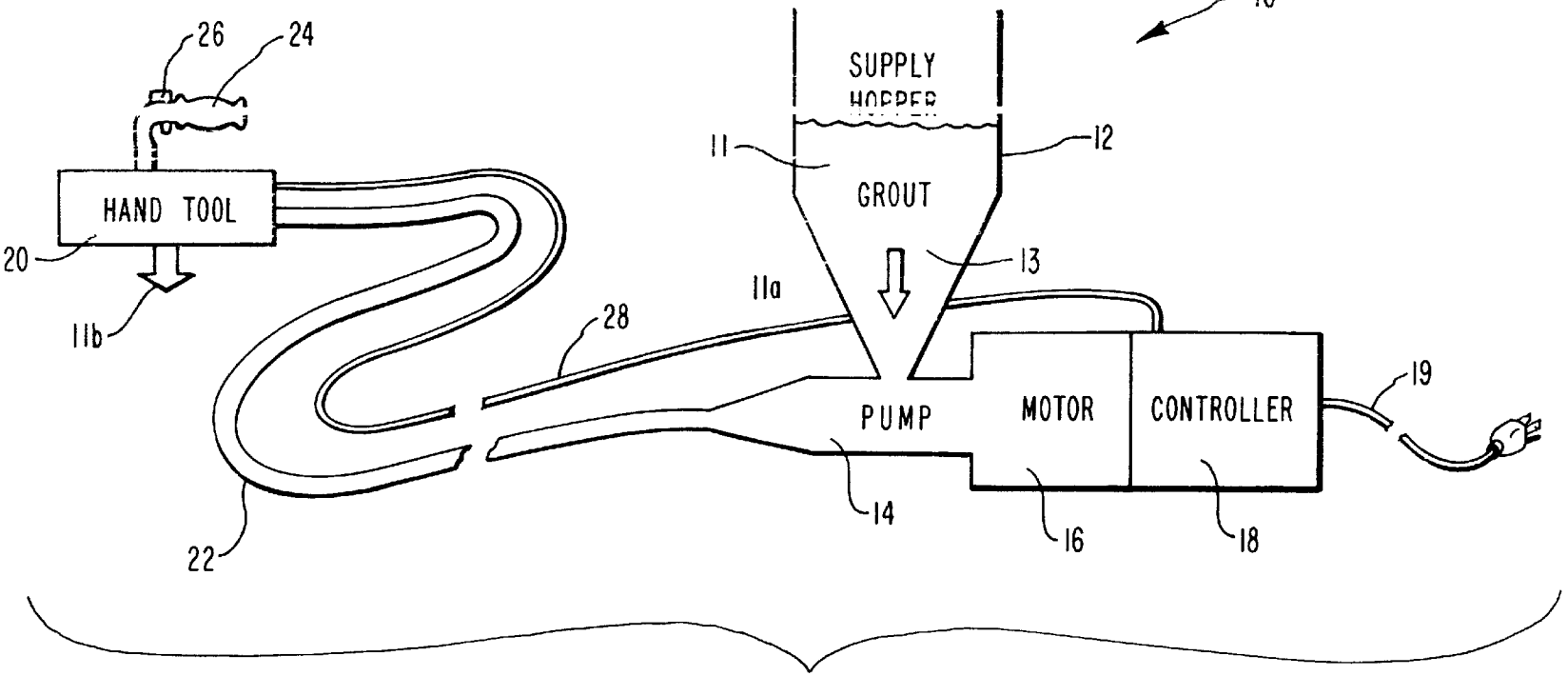
FIG. 1 is a schematic of one presently preferred embodiment of the novel grout delivery apparatus of this invention.

The invention is best understood by reference to the drawing wherein like parts are designated by like numerals throughout in conjunction with the following description.

General Discussion

The novel grout delivery apparatus and method of this invention is a unique system for the controllable delivery of a pumpable grout to the hand tool of a worker. This unique invention includes a bulk supply hopper into which a relatively large quantity of grout may be poured. This bulk supply hopper may be large enough to hold sufficient grout to enable the worker to complete the application of drywall grout in, say, a medium size residential construction. This, in turn, eliminates the presence of partially used buckets of grout scattered about the construction site. A lid or any other suitable covering may be placed over either the bulk supply hopper or even atop the grout itself to minimize drying of the exposed surface of the grout in the bulk supply hopper. The bulk supply hopper feeds the grout under the flow of gravity directly into a pump. The pump is configured as a progressing cavity pump. These pumps are commercially available and range in capacity from about one liter per minute to over one thousand liters per minute and pressures up to 450 psi. These pumps can handle almost any material that can be moved through a conduit including solids in suspension over a wide range of size and shape, even aggregate particles as large as almost three centimeters in diameter. Advantageously, the grout is uniformly discharged without pulsation in a constant steady flow, the rate of flow being proportional to the speed of rotation of the pump.

The pump is driven by a variable speed electric motor, the electric motor having sufficient horsepower to operate the pump through its entire range of operational capacity. Clearly, of course, an internal combustion engine could be used as the power source for the pump although a suitable electric motor is preferred due to its inherent capacity for precise control over a wide range of speeds as determined by a controller.

The grout delivery system is controlled by a controller, the activation of which is regulated by a worker-activated switch. The controller is any suitable controller capable of regulating the flow of electrical energy to the electric motor and thereby regulating the speed of rotation of the pump with a consequent regulation of the rate of delivery of grout to the worker. The worker-activated switch may be either directly wired to the controller or can be incorporated into a remote transmitter, the signal from which is received by the controller. Importantly, the controller is suitably preprogrammed so that each position of the switch is read as a predetermined motor/pump speed signal to be directed to the motor. The switch is configured with a plurality of control positions including an OFF position. This feature allows the worker to select any suitable rate of grout delivery to the hand tool. Further, the controller is programmable to enable the worker to selectively change the operational range of the switch for each switch setting.

The grout is delivered to the hand tool through a flexible conduit having any suitable diameter and length, depending upon the particular application. For example, it has been determined that a three-quarter inch (1.9 cm) diameter hose fifty feet (15.24 meters) long is generally adequate for the application of drywall grout on the plasterboard surface throughout a standard residence.

The hand tool is coupled to the conduit through a quick connect coupling in order to be easily replaceable. The worker simply deactivates the pump by turning the switch to the OFF position and then removes the current tool and replaces it with the second tool. These tools are well known in the construction trade and only require modification to be operable with the novel grout delivery apparatus of our invention. This, of course, specifically requires that each be configured with the appropriate coupling and a grout dispenser in the tool. The precise configuration of such tools is not the subject of this invention since this invention relates to an apparatus and method for the controllable delivery of grout to the hand tool.

DETAILED DESCRIPTION

Referring now to FIG. 1, the novel grout delivery apparatus of this invention is shown in schematic form generally at 10 and includes a supply hopper 12, a pump 14, a motor 16, a controller 18, and a hand tool 20 on the end of a flexible conduit 22. Hand tool 20 includes a handle 24 and a switch 26 mounted on handle 24. Switch 26 is in electrical contact with controller 18 through an electrical lead 28. Electrical power is supplied to controller 18 by a power cord 19.

Supply hopper 12 is configured as a bulk reservoir for a grout 11 being delivered by grout delivery apparatus 10. In one presently preferred embodiment for the delivery of a drywall grout supply hopper 12 is configured to hold about 10 or more gallons (38 liters) of grout. Supply hopper 12 terminates downwardly in a cone 13 which feeds directly into pump 14. The angle of convergence of cone 13 is specifically designed to allow grout 11 to flow downwardly under the influence of gravity into pump 14 as shown schematically by arrow 11*a*.

Figure 3:
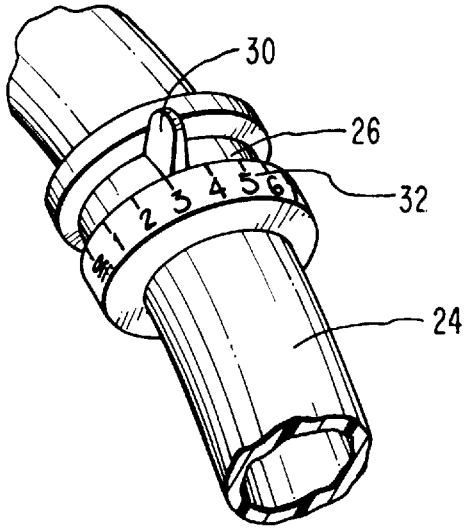
FIG. 3 is an enlargement of one embodiment of the control switch for controlling the speed of the grout pump.

Pump 14 is driven by motor 16 with the speed of motor 16 (and thus the speed and delivery output of pump 14) being selectively controlled by the input of electrical energy delivered to motor 16 by controller 18. Specifically, the control of controller 18 is initiated by switch 26 on handle 24. Referring now also to FIG. 3, one embodiment of switch 26 is shown in this fragmentary enlargement of a portion of handle 24. Switch 26 includes a switch member 30 configured to be turned through multiple positions ranging from an OFF to position 7 as shown on dial 32. Switch member 30 is specifically designed to be operated by the thumb (not shown) of the worker holding handle 24. In this manner, the worker is able to quickly and easily adjust the flow of grout 11 from hand tool 20 as shown schematically at arrow 11*b*. Advantageously, since grout 11 is a noncompressible liquid-like material, each adjustment of controller 18 by switch 20 is reflected immediately in the volume of grout 11*b* that is dispensed from hand tool 20. In this manner, the worker (not shown) can selectively control the flow of grout 11*b* by simply moving switch member 30 to the desired position and thereby achieve near-precision control over the flow of grout 11*b*. Precision control over the flow of grout 11*b* means that the worker can apply grout 11 faster and more accurately with less wastage and with very little wasted motion that would otherwise result from frequent trips to resupply hand tool 20 from a central grout supply (not shown) for grout 11.

Pump 14 is any suitable, commercially available pump for grout 11. One particularly useful pump for grout 11 is the line of pumps referred to in the art a progressing cavity pumps commercially available from Continental Pump Company, St. Louis, Mo. This line of pumps has been found to discharge various types of grout 11 with a positive pumping action as though grout 11 were being pumped through a cylinder and piston of infinite length. Further, the pressure on grout 11*b* does not depend upon the speed of the rotation of pump 14. The discharge capacity for grout 11 is approximately proportioned to the speed of pump 14. Importantly, grout 11*b* is discharged from hand tool 20 uniformly and without pulsation so that the worker is able to dispense grout 11*b* in a constant, steady flow, the rate of which is easily controlled by switch 26. The discharge of grout 11*b* remains constant with each revolution of pump 14 so that the worker receives an accurate, predictable quantity of grout 11*b*. Another important feature of this particular brand of pump is that grout 11 is pumped with a minimum amount of turbulence, agitation, pulsation, or separation disturbance. Pumping action of pump 14 starts immediately upon movement of switch member 30 from the OFF position on dial 32 and stops immediately when switch member 30 is returned to the OFF position.

Figure 2:
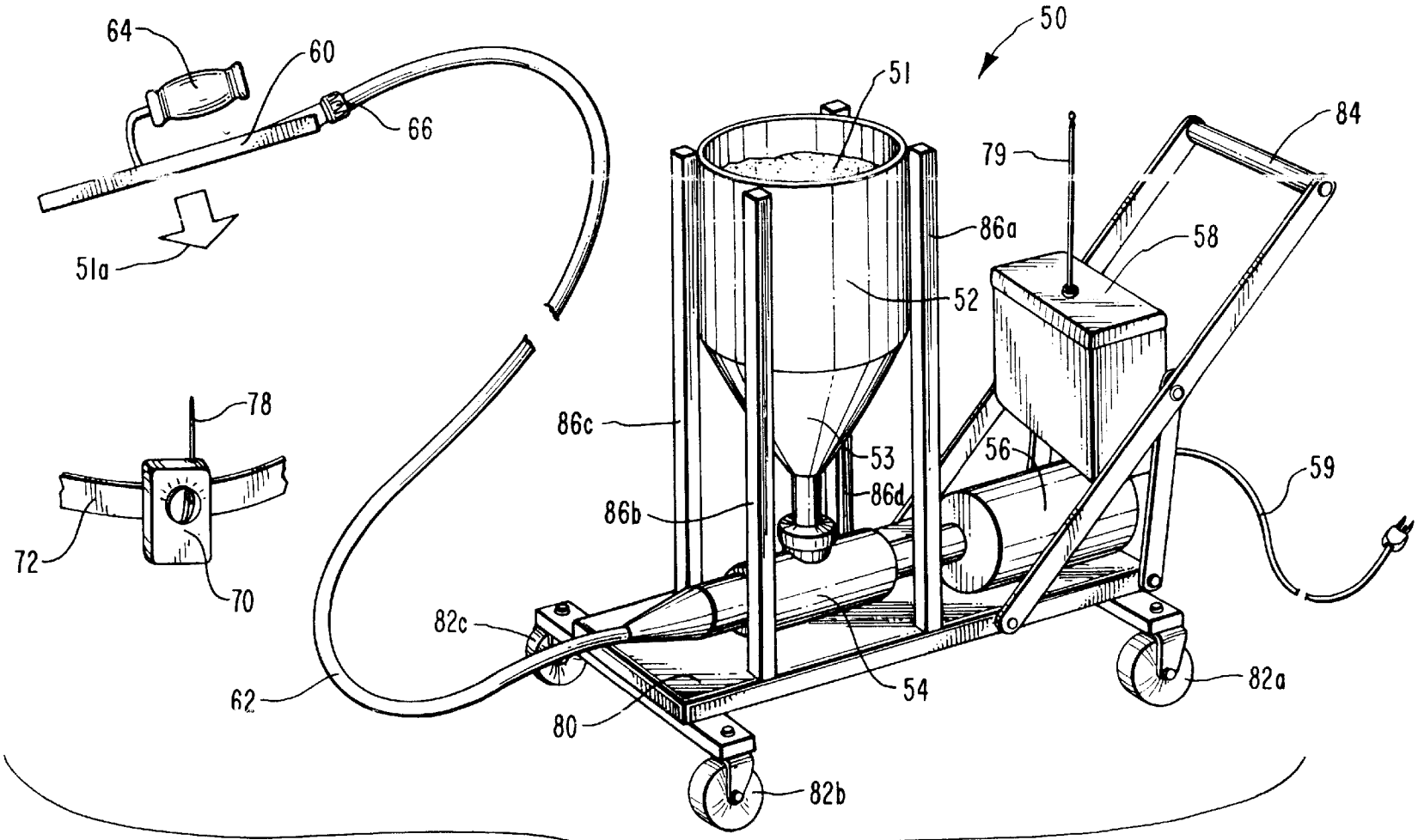
FIG. 2 is a perspective view of one presently preferred embodiment of the grout delivery apparatus.

Referring now to FIG. 2, a first preferred embodiment of my novel grout delivery apparatus is shown generally at 50 and includes a supply hopper 52 filled with a grout 51. Supply hopper 52 feeds grout 51 downwardly through a funnel 52 into a pump 54. Pump 54 is driven at a preselected speed of rotation (as will be described more fully hereinafter) by an electric motor 56. A controller 58 receives electrical energy through a power cord 59 and controllably delivers this electrical energy to electric motor 56 thereby selectively controlling the speed of rotation of electric motor 56 and, correspondingly, the speed of rotation of pump 54. As set forth hereinbefore, the rate of rotation of pump 54 determines the rate at which grout 51 is delivered through a flexible conduit 62 to a hand tool, shown herein as a trowel 60 having a handle 64 thereon. Grout 51 delivered to trowel 60 is shown schematically as grout 51*a*.

As is well known in the construction trade, trowel 60 may be any suitable hand tool useful in the specific application of grout 51. These hand tools can include a simple nozzle, a wide applicator, a corner tool, a brick mason's trowel, a tape applicator (none shown) to name a few. Advantageously, a coupling 66 on the end of flexible conduit 62 allows the worker to quickly and easily interchange trowel 60 for any other hand tool suitable for use with grout 51. Interchangeability of trowel 60 means that the switch mechanism of switch 26 (FIGS. 1 and 2) requires a modification unless each of the interchangeable tools described above were to be fitted with switch 26. Accordingly, in this presently preferred embodiment of grout delivery apparatus 50 controller 58 has been configured to be controllable remotely by a belt-mountable transmitter 70 releasably mounted to a belt 72 worn by the worker (not shown).

Figure 4:
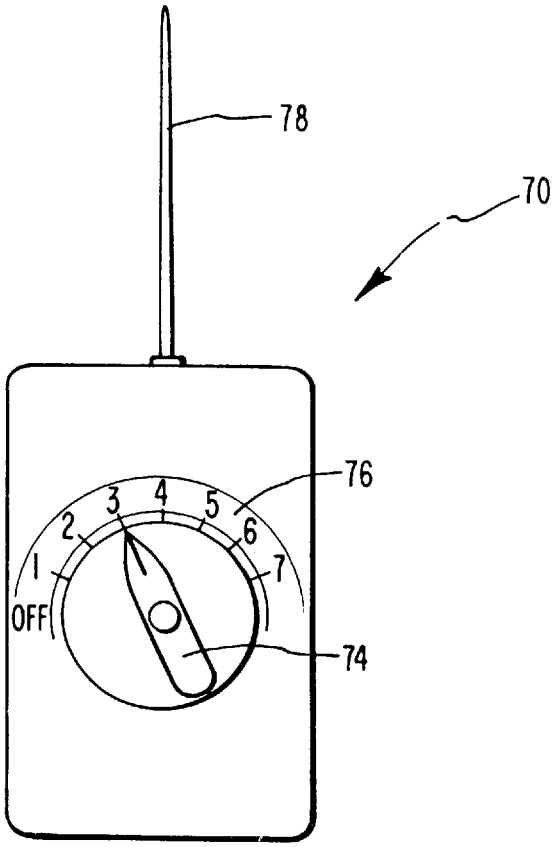
FIG. 4 is a belt mounted transmitter for remotely controlling the speed of the grout pump.

Referring now also to FIG. 4, transmitter 70 is shown approximately to scale and includes a switch 74 rotatable about a dial 76 having positions thereon ranging from OFF through 7. Transmitter 70 is battery powered and includes an antenna 78 for transmitting signals from transmitter 70 to a receiving antenna 79 on controller 58. Transmitter 70 is a low power transmitter having a limited range of, say, 30 meters so as to avoid interference problems and to minimize regulatory problems encountered by the use of transmitters having higher output capacity. In this way, the worker is able to work at the full length of flexible conduit 62 without worrying about electrical lead 28 (FIG. 1) and in the absence of a switch (switch 26, FIGS. 1 and 2) which would otherwise require replacement each time trowel 60 were replaced. Further, with transmitter 70 releasably mounted to the belt 72 of the worker, the worker is free to switch trowel 60 from hand to hand without worrying about the necessity of having access to a switch that would otherwise be located on handle 64. Further, it is well known in the construction trade that grout 51 becomes spattered all over trowel 60 with the consequence that any switch on handle 64 could become fouled with grout 51*a* unless special shielding steps are taken to shield the switch. Clearly, of course, each technique for control of the speed of pumps 14 (FIG. 1) and 54 (FIG. 3) whether through switch 26 (FIGS. 1 and 2) or through transmitter 70 (FIGS. 3 and 4) respectively, the important consideration is the accurate and controllable delivery of the respective grout.

Grout delivery apparatus 50 is mounted on cart 80 having a plurality of wheels thereon, wheels 82*a*–82*c*, for allowing cart 80 to be pushed from place to place. A handle 84 enables the person moving cart 80 to easily and conveniently push or pull cart 80. Cart 80 also includes a framework formed as uprights 86*a*–86*d* which support supply hopper 52 above pump 54. In this configuration grout delivery apparatus 50 is readily transported about the specific work site and between work locations.

THE METHOD

In the practice of the method of this invention, the worker (not shown) wheels cart 80 to a preselected position and plugs electrical cord 59 into a suitable electrical outlet (not shown). Thereafter, a suitable grout 51 is poured into supply hopper 52 where it is directed by funnel 53 into pump 54. The appropriate trowel 60 is then coupled at coupling 66 to flexible conduit 62. The worker is now ready to initiate the delivery of grout 51*a* to trowel 60. This is done by activating transmitter 70 by turning switch 74 from the OFF position to any predetermined setting on dial 76. Once the worker determines the desired rate of delivery of grout 51*a* to trowel 60, a desired change in this flow rate is accomplished by the simple step of turning switch 74 to another preselected position on dial 76. This allows the worker to accurately dispense and apply grout 51*a* with trowel 60 until the supply of grout 51 in supply hopper 52 has been depleted. Customarily, an experienced worker will be able to predetermine the approximate quantity of grout 51 required for a particular task so that excess grout 51 will not be required. However, for these types of grout 51 that require air drying and do not harden with a relatively short time period such as experienced with cement-based grouts, the worker is supplied with a suitable lid (not shown) for supply hopper 52, thereby reducing the tendency for the exposed surface of grout 51 to air dry.

As a demonstration of the efficacy of grout delivery apparatus 50, in one test involving an experimental prototype of grout delivery apparatus 50 an experienced worker completed the application of both drywall compound and tape over the entire wall surface and ceiling of a medium size home in significantly less time than customarily required to complete the task using conventional techniques. Not only was less time required to complete this particular task, the task was accomplished with less wastage of grout 51 which significantly reduced the required cleanup time in addition to contributing to the overall savings in the amount of grout 51 consumed in the task. Perhaps even more importantly, the productivity of the worker was increased substantially at a consequent reduction in worker fatigue.

This in turn, means that a worker applying grout 51 with the unique device of grout delivery apparatus 50 is able to work more accurately and at a significant reduction in fatigue-related accidents.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A grout delivery apparatus comprising:

a grout supply hopper having a supply of grout therein;

a grout pump in fluid communication with said grout hopper, said grout pump being operable to deliver the grout under pressure;

a motor for turning said grout pump;

a controller for selectively controlling the speed of said motor;

a flexible conduit in fluid communication with said grout pump for delivering the grout to a work site; and selector means at said work site for selectively controlling said controller thereby controlling the rate of delivery of the grout to the work site, said selector means including electronic means for electrically controlling said motor thereby simultaneously controlling said grout pump, said selector means including a switch means for adjustably controlling said selector means, said switch means being configured as a transmitter for transmitting switch settings from the work site to said selector means.

2. The grout delivery apparatus defined in claim 1 wherein said grout supply hopper includes a conical feed section for directing grout from said grout supply hopper into said grout pump.

3. The grout delivery apparatus defined in claim 1 wherein said grout pump is configured as a progressing cavity pump so that the capacity of said grout pump is proportional to the speed at which said grout pump is driven by said motor.

4. The grout delivery apparatus defined in claim 1 wherein said switch means comprises a dial having a plurality of settings, each of said settings providing said controller with a discrete operating speed.

5. The grout delivery apparatus defined in claim 1 wherein said switch means is configured as a switch on a hand tool at the work site.

6. The grout delivery apparatus defined in claim 1 wherein said grout delivery apparatus includes cart means for transporting said grout delivery apparatus from place to place.

7. A grout delivery apparatus for controllably delivering a pumpable grout to a handpiece comprising:

a framework;

a grout supply hopper mounted to said framework;

a grout pump mounted to said framework and in fluid communication with said grout supply hopper, said grout pump comprising a progressing cavity pump so that said grout is delivered through said flexible conduit at a rate proportional to the rate of rotation of said grout pump;

a motor for turning said grout pump;

a controller for selectively controlling the speed of said motor, said controller including control means at the remote location for regulating said controller, said control means including a transmitter for transmitting control signals to said controller;

a flexible conduit affixed to said pump and operable to deliver grout from said pump to a remote location; and selector means at said remote location for selectively controlling said controller thereby controlling the rate of delivery of grout to said remote location.

8. The grout delivery apparatus defined in claim 7 wherein said framework includes wheel means for moving said grout delivery apparatus.

9. The grout delivery apparatus defined in claim 7 wherein said grout supply hopper is mounted to said framework above said grout pump and includes a funnel means for directing said grout from said grout supply hopper into said grout pump under gravity.

10. The grout delivery apparatus defined in claim 7 wherein said control means includes a switch means on said flexible conduit for selectively controlling said controller.

11. A method for delivering grout to a work site comprising the steps of:

placing a quantity of grout in a grout supply hopper;

feeding said grout into a grout pump;

pumping said grout through a flexible conduit to the work site with said grout pump;

remotely controlling the speed of said grout pump with a transmitter thereby regulating the rate of delivery of said grout through said flexible conduit; and selectively operating said transmitter at the work site thereby controlling the rate of delivery of grout to the work site.

12. The method defined in claim 11 wherein said pumping step comprises delivering said grout through said flexible conduit at a controllable rate by pumping said grout with a progressing cavity pump.

13. The method defined in claim 11 wherein said controlling step includes selecting a switch setting for the speed of said progressing cavity pump.

* * * * *